US012791283B2

(12) United States Patent
Cragg

(10) Patent No.: US 12,791,283 B2
(45) Date of Patent: Nov. 10, 2026

(54) SAFETY HOLSTERS

(71) Applicant: James Cragg, Carson, CA (US)

(72) Inventor: James Cragg, Carson, CA (US)

( * ) Notice: Subject to any disclaimer, the term of this patent is extended or adjusted under 35 U.S.C. 154(b) by 71 days.

(21) Appl. No.: 18/945,418

(22) Filed: Nov. 12, 2024

(65) Prior Publication Data

US 2025/0155221 A1 May 15, 2025

Related U.S. Application Data

(60) Provisional application No. 63/548,010, filed on Nov. 10, 2023.

(51) Int. Cl.
*F41C 33/02* (2006.01)
*F41C 33/04* (2006.01)

(52) U.S. Cl.
CPC ..... *F41C 33/0263* (2013.01); *F41C 33/041* (2013.01)

(58) Field of Classification Search
CPC .... F41C 33/0263; F41C 33/041; F41C 33/02; F41C 33/0209; F41C 33/0245; F41C 33/0272
See application file for complete search history.

(56) References Cited

U.S. PATENT DOCUMENTS

| | | | | |
|---|---|---|---|---|
| 7,434,712 | B2 * | 10/2008 | Cook | F41C 33/0254 224/193 |
| 8,870,042 | B2 * | 10/2014 | Clifton | A45F 5/021 224/198 |
| 9,766,037 | B2 * | 9/2017 | Irwin | F41C 33/0227 |
| 9,816,778 | B2 * | 11/2017 | Bardy | F41C 33/0272 |
| 9,829,275 | B2 * | 11/2017 | Madrid | F41C 33/0209 |
| 10,317,169 | B2 * | 6/2019 | McKendrick | F41C 33/0263 |
| 10,352,651 | B1 * | 7/2019 | Vredenburg | F41C 33/0236 |
| 10,458,748 | B2 * | 10/2019 | Yeates | F41C 33/0272 |
| 10,473,427 | B1 * | 11/2019 | Sereday | F41C 33/0254 |
| 12,364,323 | B2 * | 7/2025 | Michael | A45F 5/021 |
| 2005/0024807 | A1 * | 2/2005 | Cerovic | F41H 13/0018 361/232 |

* cited by examiner

*Primary Examiner* — Corey N Skurdal
(74) *Attorney, Agent, or Firm* — Camuti Law Group APC; Nathan Camuti

(57) ABSTRACT

There is provided improved safety holsters comprising a holster body and a retention clip, a securing tab proximate to the terminal end of the retention clip, wherein the holster body includes a receiving portion for receiving the firing end of a side-arm when the sidearm is installed in the improved safety holster, and wherein the receiving portion includes a pressure retention element comprising a pressure plate and spring elements configured to apply a retention force between the improved safety holster and the side arm when the side arm is installed in the improved safety holster, and wherein the retention clip is rigid to retain the side arm in place and may require intentional action by a user to remove the side arm from the improved safety holster, wherein the intentional action is applying a removal force to operate the retention pressure element to unholster the sidearm.

15 Claims, 8 Drawing Sheets

SAFETY HOLSTERS

BACKGROUND

The present invention relates generally to holsters for sidearms, and particularly to a safety holster system for securing a sidearm in the holster such that specific, intentional force must be applied in order to remove the sidearm from the holster.

A common issue faced by users of many styles of holster for sidearms is the dislodging of the sidearm from the holster by unintentional movements of the user or others. This may result in accidental discharge of the sidearm, causing injury to the user of the holster or bystanders and posing a significant safety risk. Users of multiple sidearms, such as a lethal sidearm and a less than lethal sidearm, may and have drawn the incorrect sidearm in moments necessitating a quick reaction. Such moments leave little time to discern which sidearm the user is attempting to draw. Mistakes regarding the nature of the sidearm the user has drawn have resulted in preventable injury and loss of life.

SUMMARY OF INVENTION

Therefore, there is a need for a new improved safety holster design which allows a user to discern which sidearm they are drawing and prevents the unintentional removal of the sidearm from the holster. The new improved safety holster design for a safer, more secure holster for a sidearm offers users a holster that releases the sidearm only when an intentional removal force is applied to the sidearm. In so doing, the new improved safety holster design allows users to discern which sidearm they are drawing, and significantly reduces the likelihood that a sidearm will be unintentionally dislodged from the improved safety holster or unintentionally discharged.

The new design for an improved safety holster consists of a housing configured to receive the sidearm, which may be made of one or more of a thermoplastic, thermoplastic acrylic-polyvinyl chloride, nylon, polymer, or other appropriate material as is known in the art. The housing possesses an internal tab in a portion of the housing proximal to a lower terminal end of the housing, which forms a substantially planar retention barrier thereby holding a retention pressure mechanism in place at the lower terminal end of the housing.

A retention clip extends horizontally from an upper terminal end of the housing. In some embodiments, the retention clip is a substantially rigid lever arm that retains the sidearm in place when the pistol style-sidearm is inserted into the housing, thereby requiring intentional action to remove the sidearm from the housing. A tab extends from a terminal end of the retention clip. In some embodiments, the tab is used to apply a removal force when the user is removing the sidearm from the housing.

A retention element extends vertically downwards from a lower face of the retention clip. In some embodiments, the retention clip interacts with a non-firing end of a sidearm when the sidearm is inserted into the housing, thereby exerting a first retention force on the sidearm when the sidearm is inserted into the housing. In some embodiments, the exerted first retention force is one that prevents removal of the sidearm from the housing without intentional effort.

A retention strap is fastened to a first side of the housing and extends around the housing to a second side of the housing. The second side of the housing possesses a securing element capable of selectively fastening the retention strap to the second side. Fastening the retention strap around the housing when a sidearm is inserted in the housing thereby exerts a second retention force against the sidearm when the sidearm is inserted in the housing. In some embodiments, the retention strap is one or more of a nylon, or other flexible material suitable for retaining the sidearm in the housing and applying the requisite second retention force as is known to those skilled in the art. In some embodiments, the securing element is one or more of a snap, a button, a hook-and-loop fastener, or other similar method of fastening as is known to those skilled in the art. In some embodiments, the first side of the housing the retention strap is fastened to is the side of the housing facing away from the user of the housing.

An installation cover engages with the lower body of the housing and encloses the lower body of the housing when the installation cover is installed in the housing. In some embodiments, the installation cover possesses a pair of prongs and tabs extending from a terminal end of the installation cover that insert into the lower body of the housing. In some embodiments, the installation cover engages with the lower body of the housing through an installation port on a side of the lower body of the housing. In some embodiments, there are two installation ports. In some embodiments, the installation ports are apertures in the body of the housing which interface with the prongs and tabs on the installation cover to retain the installation cover in place when the installation cover is installed in the lower body of the housing. In some embodiments, the installation cover includes additional internal tabs that form a substantially planar retention barrier to hold the retention pressure mechanism in place near the lower terminal end of the housing.

A retention pressure mechanism is located in the lower terminal end of the housing. The retention pressure mechanism applies a third retention force on the firing end of a sidearm when the sidearm is inserted into the housing. In some embodiments, the retention pressure mechanism may be one or more of a plate, spring-loaded element, or similar device. In some embodiments, the retention pressure mechanism may require the user to apply an installation force on the sidearm when inserting the sidearm in the housing, thereby compressing the retention pressure mechanism and allowing the sidearm to pass the retention element for insertion into the housing. In some embodiments, the third retention force applied by the retention pressure mechanism is an upward retention force which thereby engages the sidearm with the retention clip and retention element at the upper terminal end of the housing. In some embodiments, the retention pressure mechanism may move in either a linear manner or a pivoting manner. In some embodiments, the retention pressure mechanism may be configured such that the spring elements create a fulcrum that allows the retention pressure mechanism to rotate or tilt as an installation or removal force is applied to the retention pressure mechanism. In some embodiments, the retention pressure mechanism is substantially parallel to the lower terminal end of the housing when at rest. In some embodiments, the retention pressure mechanism includes a pressure plate, wherein the pressure plate is a substantially planar surface that creates a lower terminal end of the housing when installed in the housing. In some embodiments, the retention pressure mechanism also includes at least one spring element. In some embodiments, the at least one spring element may be attached to the pressure plate near a terminal end of the pressure plate that is opposite to the installation cover.

Further details and advantages of the invention may be seen from the following brief description of the drawings and detailed description, in conjunction with the accompanying drawings, wherein like reference numerals represent like parts.

DETAILED DESCRIPTION

Figure 1:
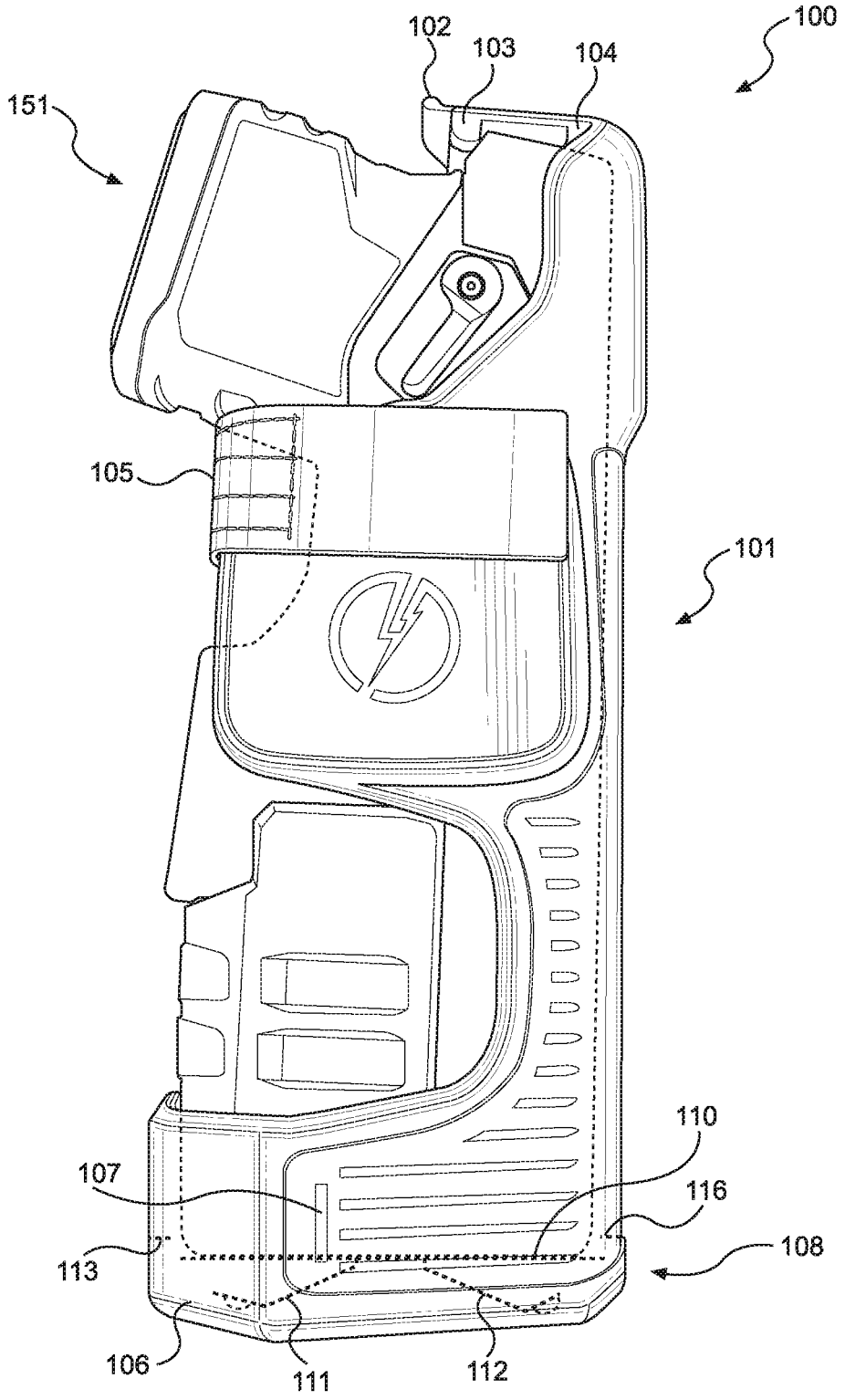
FIG. 1 shows a side view of an improved safety holster with a sidearm holstered therein, according to one embodiment of the present disclosure.

The following description contains specific information pertaining to embodiments and implementations in the present disclosure. The drawings in the present application and their accompanying detailed description are directed to merely exemplary implementations. Unless noted otherwise, like or corresponding elements among the figures may be indicated by like or corresponding reference numerals. Moreover, the drawings and illustrations in the present application are generally not to scale and are not intended to correspond to actual relative dimensions.

FIG. 1 shows a side view of an improved safety holster with a sidearm holstered therein, according to one embodiment of the present disclosure. System 100 includes improved safety holster 101 and sidearm 151. In some embodiments, sidearm 151 may be a less-lethal device used to incapacitate an individual using electrical current or other less-lethal method of incapacitation. Sidearm 151 is shown for context and demonstration. In some embodiments, sidearm 151 may be a tool carried to implement less-lethal force in the use of force continuum, such as a stun gun, a Taser® brand sidearm, or other less-lethal sidearm. In other embodiments, improved safety holster 101 may be used to holster a lethal device, such as a firearm. As shown in FIG. 1, improved safety holster 101 includes tab 102, retention element 103, retention clip 104, retention strap 105, installation cover 106, installation port 107, and retention pressure mechanism 108 (internal, not visible).

Improved safety holster 101 is a holster for holding a sidearm. Improved safety holster 101 may be a plastic, such as a thermoplastic, thermoplastic acrylic-polyvinyl chloride, nylon, polymer, or other appropriate material. Improved safety holster 101 includes tab 102. Tab 102 protrudes form the terminal end of retention clip 104. In some embodiments, tab 102 may be used to apply a removal pressure when a user is removing or unholstering sidearm 151 from improved safety holster 101. Retention element 103 protrudes form retention clip 104 to engage sidearm 151. In some embodiments, retention clip 104 is a substantially rigid lever arm used to retain sidearm 151 in place and may require intentional action by a user to remove sidearm 151 from improved safety holster 101. Retention element 103 may extend from a sidearm side of retention clip 104. When sidearm 151 is installed in improved safety holster 101, retention element 103 may engage sidearm 151 in a manner to secure sidearm 151 in improved safety holster 101 and prevent removal of sidearm 151 from improved safety holster 101 without the user making intentional effort.

Retention strap 105 is a strap for retaining sidearm 151 in improved safety holster 101. Retention strap 105 may be a nylon strap or other flexible material suitable for retaining sidearm 151 in improved safety holster 101. In some embodiments, retention strap 105 may connect to a body of improved safety holster 101 by a securing element, such as a snap, a button, or a hook-and-loop fastener. In some embodiments, securing strap 105 may connect to improved safety holster 101 on a side near a user when improved safety holster 101 is worn to carry sidearm 151. Installation cover 106 may be a selectively removable for installing, securing, and removing elements of improved safety holster 101. As shown in FIG. 1, installation cover 106 may engage with a body of improved safety holster 101 to enclose a lower end of improved safety holster 101 that receives the firing end of sidearm 151 when sidearm 151 is inserted in improved safety holster 101. Retention cover 106 may engage with the body portion of improved safety holster 101 via installation port 107. As shown in FIG. 1, installation port 107 is an aperture in the body of improved safety holster 101 that receives a tab of retention cover 106 and holds retention cover 106 in place.

Retention pressure mechanism 108 (internal) may be a plate or spring-loaded element included in improved safety holster 101 to apply a retention force on sidearm 151 when sidearm 151 is loaded into improved safety holster 101. In some embodiments, retention pressure mechanism 108 may require a user to apply an installation force on sidearm 151 to compress retention pressure mechanism 108 and allow sidearm 151 to clear retention element 103 for installation in improved safety holster 101. After the user applies the installation force to compress retention pressure mechanism 108, the user is able to rotate sidearm 151 into alignment with the body of improved safety holster 101 and release the installation pressure. Retention pressure mechanism 108 applies a retention force on the firing end of sidearm 151 to engage sidearm 151 with retention element 103 and retention clip 104. In some embodiments, retention pressure mechanism 108 may move in a linear manner along the direction of the long axis of improved safety holster 101 or sidearm 151. In other embodiments, retention pressure mechanism 108 may include a pivot motion allowing the user to rotate sidearm 151 such that a plate of retention pressure mechanism 108 engages with the firing end of sidearm 151 and rotates with sidearm 151 as the user installs sidearm 151 into improved safety holster 101.

The rotation of sidearm 151 and associated rotation of retention pressure mechanism 108 may be a rotation through an acute angle. In some embodiments, retention pressure mechanism 108 may be substantially parallel to the terminal end of improved safety holster 151 when at rest, that is, when sidearm 151 is not being installed or removed from improved safety holster 101. During operation of improved safety holster 101, the user may place sidearm 151 into improved safety holster 101 by pressing down on the handle of sidearm 151 to depress retention pressure mechanism 108. The spring supports of the retention pressure mechanism may be compressed allowing installation of sidearm 151 into improved safety holster 101. When the user releases the installation pressure, the retention pressure mechanism may apply a retention pressure on sidearm 151, pressing sidearm 151 upwards in improved safety holster 101. As a result, retention element 103 may secure sidearm 151 in place.

Operation of improved safety holster 101 may prevent accidental operation of an unintended sidearm. In a reactive moment, a user wearing more than one sidearm may grab a sidearm, point the sidearm, and discharge the sidearm quickly. Such a quick operation may result in the user retrieving and/or operating an unintended sidearm. Improved safety holster 101 may prevent such accidental use by preventing retrieval of sidearm 151 without application of a removal force to operate the retention pressure element to unholster sidearm 151.

As shown in FIG. 1, system 100 includes retention pressure mechanism 108 comprising contact pressure plate 110 and spring elements 111 and 112. In some embodiments, retention pressure mechanism 108 may be positioned in the body of improved safety holster 101 and retained in position by tabs 113 and 116. Improved safety holster 101 may optionally include additional tabs for securing and retaining retention pressure mechanism 108. Tabs 113, 114, and addition optional tabs may form a substantially planar retention barrier to hold retention pressure mechanism 108 in the receiving and of improved safety holster 101. In some embodiments, contact pressure plate 110 of retention pressure mechanism 108 may contact tabs 113 and 116, as well as additional optional tabs, when improved safety holster 101 does not have a sidearm installed. However, as shown in FIG. 1, sidearm 151 is installed in improved safety holster 101. Retention pressure mechanism 108 applies a retention force on installed sidearm 151 causing tab 102, retention element 103, and retention clip 104, to engage sidearm 151 and securely retain sidearm 151 in improved safety holster 101.

Figure 2:
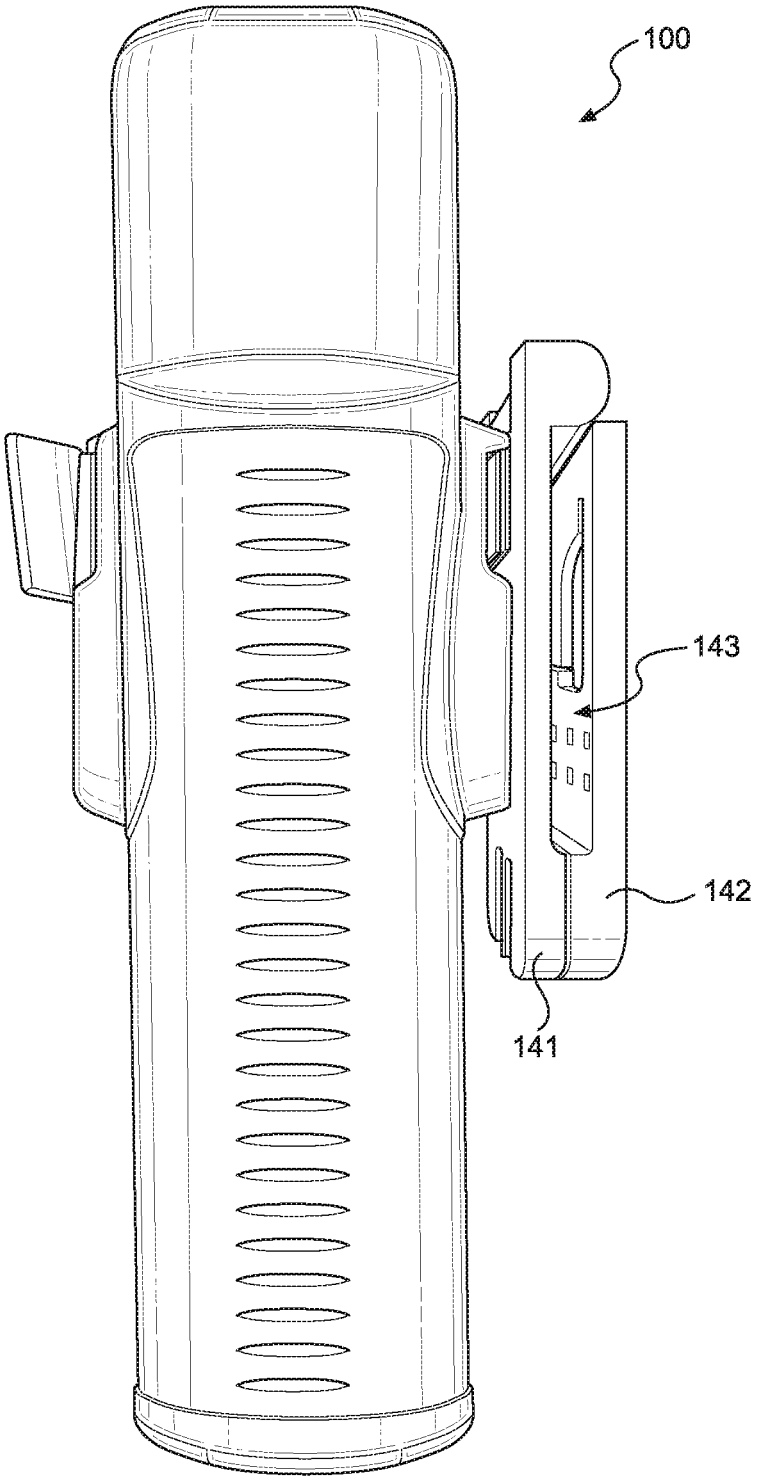
FIG. 2 shows a front view of the improved safety holster of FIG. 1, according to one embodiment of the present disclosure.

FIG. 2 shows a front view of the improved safety holster of FIG. 1, according to one embodiment of the present disclosure. As shown in FIG. 2, system 100 includes a belt clip comprising inner clip plate 141 and outer clip plate 142. The belt clip comprises belt channel 143, through which a belt may pass for securing system 100 to a user or a user's belongings.

Figure 3:
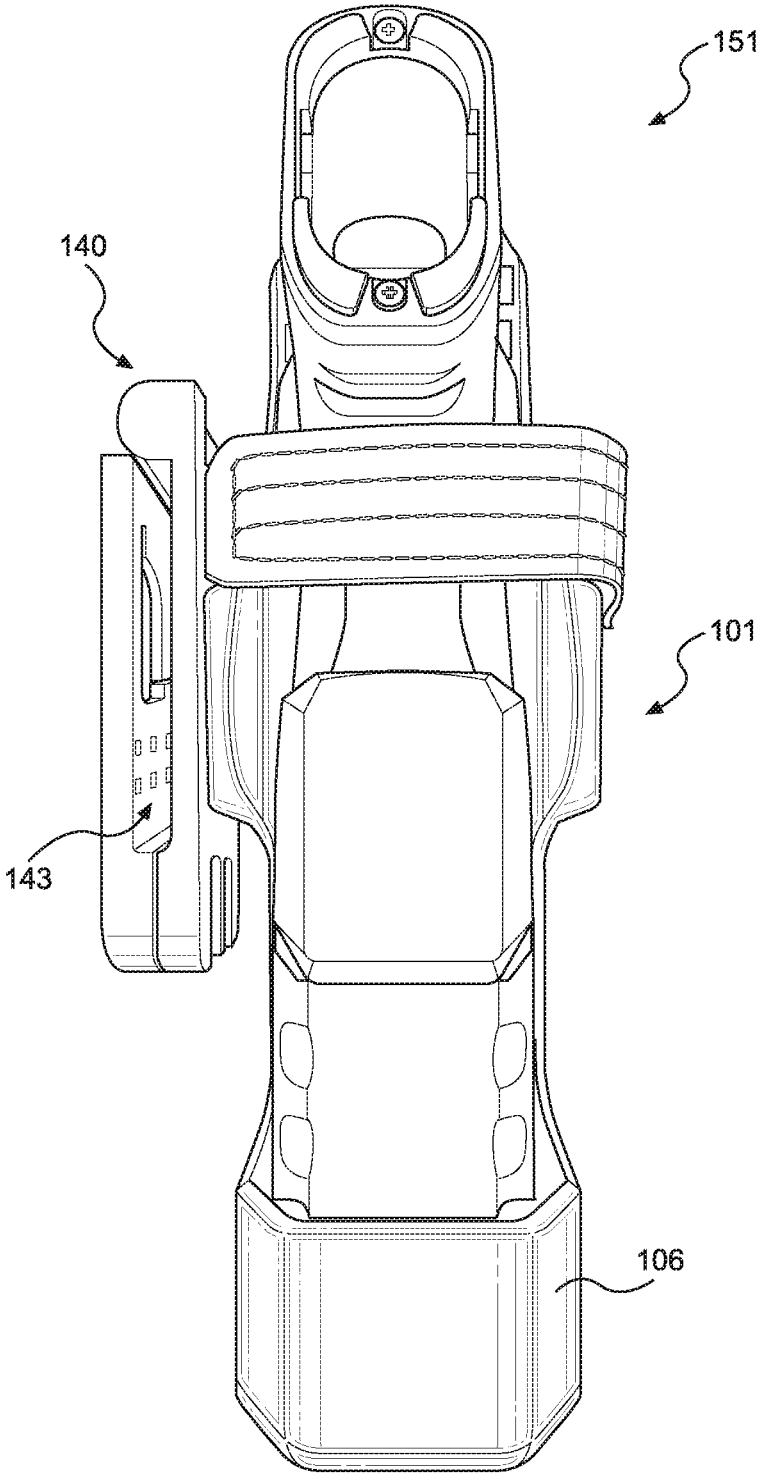
FIG. 3 shows a rear view of the improved safety holster of FIG. 1, according to one embodiment of the present disclosure.

FIG. 3 shows a rear view of the improved safety holster of FIG. 1, according to one embodiment of the present disclosure. As shown in FIG. 3, sidearm 151 is installed in improved safety holster 101. Belt clip 140 includes belt channel 143 and installation cover 106 is installed in improved safety holster 151.

Figure 4:
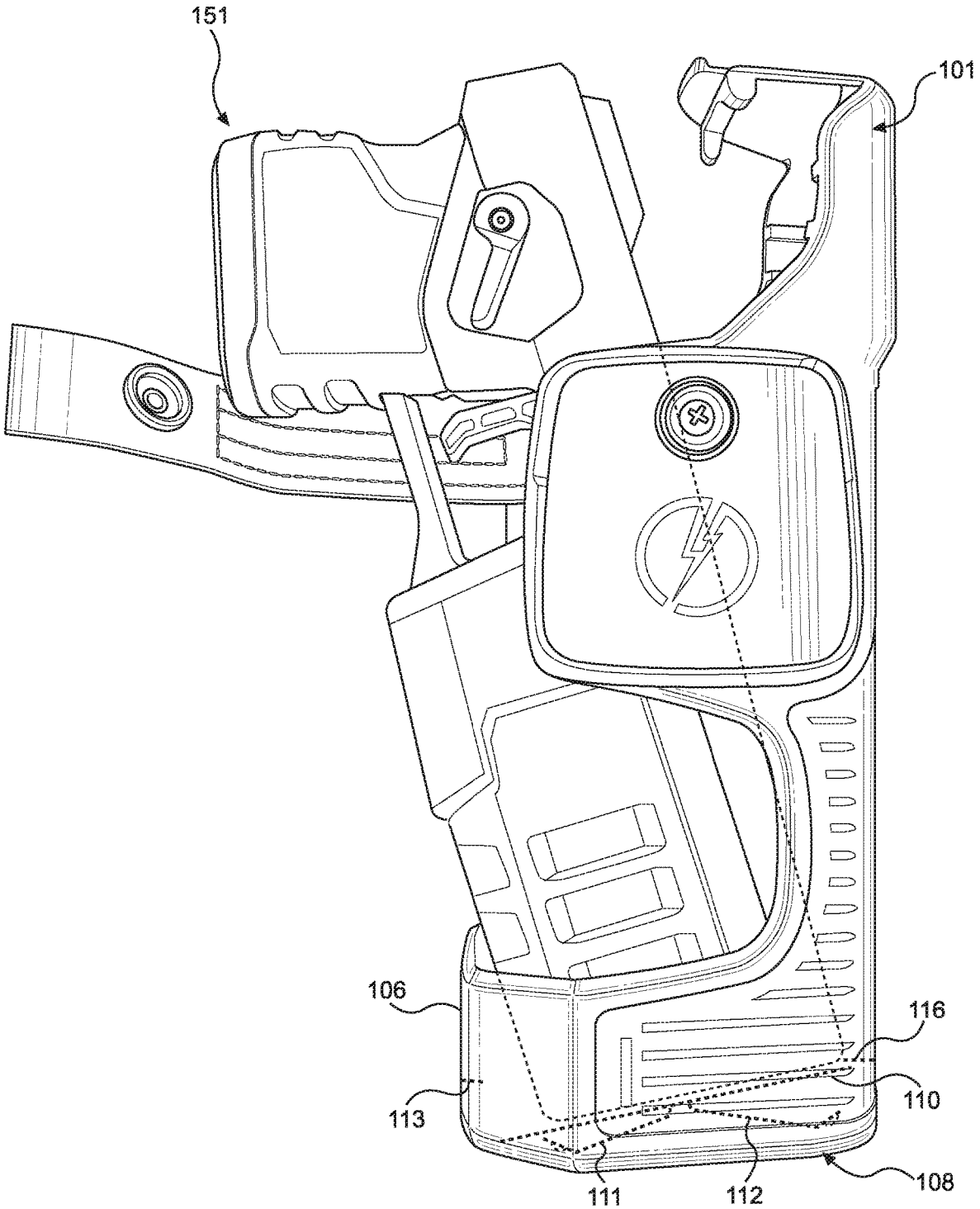
FIG. 4 shows another side view of the improved safety holster shown in FIG. 1 with the sidearm partially unholstered, according to one embodiment of the present disclosure.

FIG. 4 shows another side view of the improved safety holster shown in FIG. 1 with the sidearm partially unholstered, according to one embodiment of the present disclosure. As shown in FIG. 4, sidearm 151 is not fully installed in improved safety holster 101. If a user were to rotate sidearm 151 towards the body of improved safety holster 101 to holster sidearm 151, the rear portion of the body of sidearm 151 would hit retention element 103. To install sidearm 151 in improved safety holster 101, the user has to take intentional action to apply an installation force pressing sidearm 151 into improved safety holster 101, compressing retention pressure element 108. When the installation pressure is applied, sidearm 151 is in an orientation to allow sidearm 151 to clear retention element 103. After sidearm 151 is rotated into holstering position and the user releases the installation pressure, retention pressure mechanism 108 applied a retention force positioning sidearm 151 such that retention element 103 engages with retention pocket 152. Retention pocket 152 may receive retention element 103 to secure sidearm 151 in place when sidearm 151 is holstered in improved safety holster 101.

As shown in FIG. 4, tabs 113 and 116 and retention pressure mechanism 108 are internal. Retention pressure mechanism 108 is installed in improved safety holster 101. Pressure plate 110 is compressed towards spring element 111, allowing sidearm 151 to be removed from improved safety holster 101. Spring element 112 is extended allowing pressure plate 110 to contact tab 116.

Figure 5:
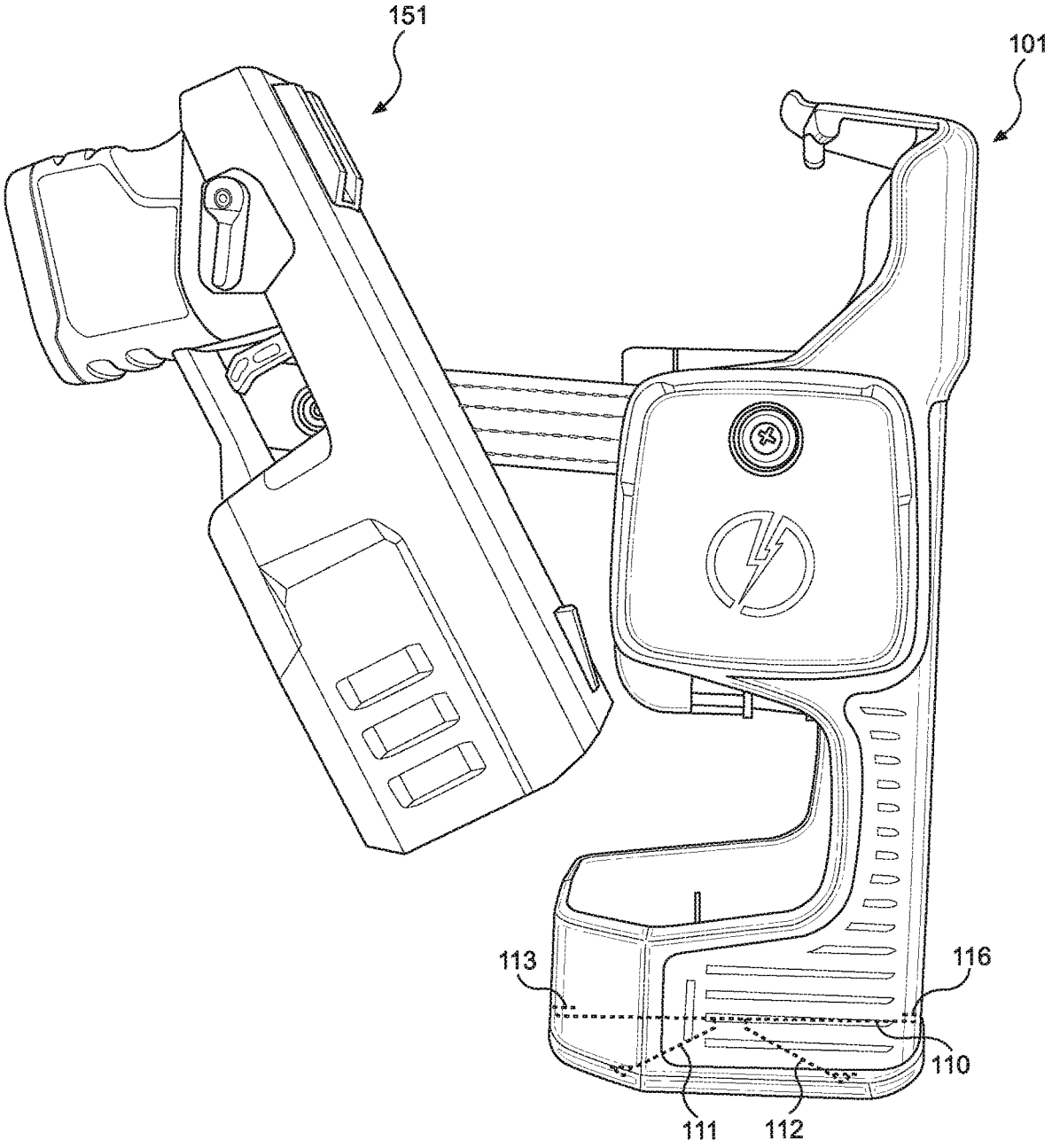
FIG. 5 shows another side view of the improved safety holster shown in FIG. 1 with the sidearm fully unholstered, according to one embodiment of the present disclosure.

FIG. 5 shows another side view of the improved safety holster shown in FIG. 1 with the sidearm fully unholstered, according to one embodiment of the present disclosure. As shown in FIG. 5, tabs 113 and 116 and retention pressure mechanism 108 are internal. Retention pressure mechanism 108 is installed in improved safety holster 101. Pressure plate 110 is not compressed. Spring element 111 and spring element 112 are extended allowing pressure plate 110 to contact tab 116 and tab 113, retaining pressure mechanism 108 in improved safety holster 101.

Figure 6:
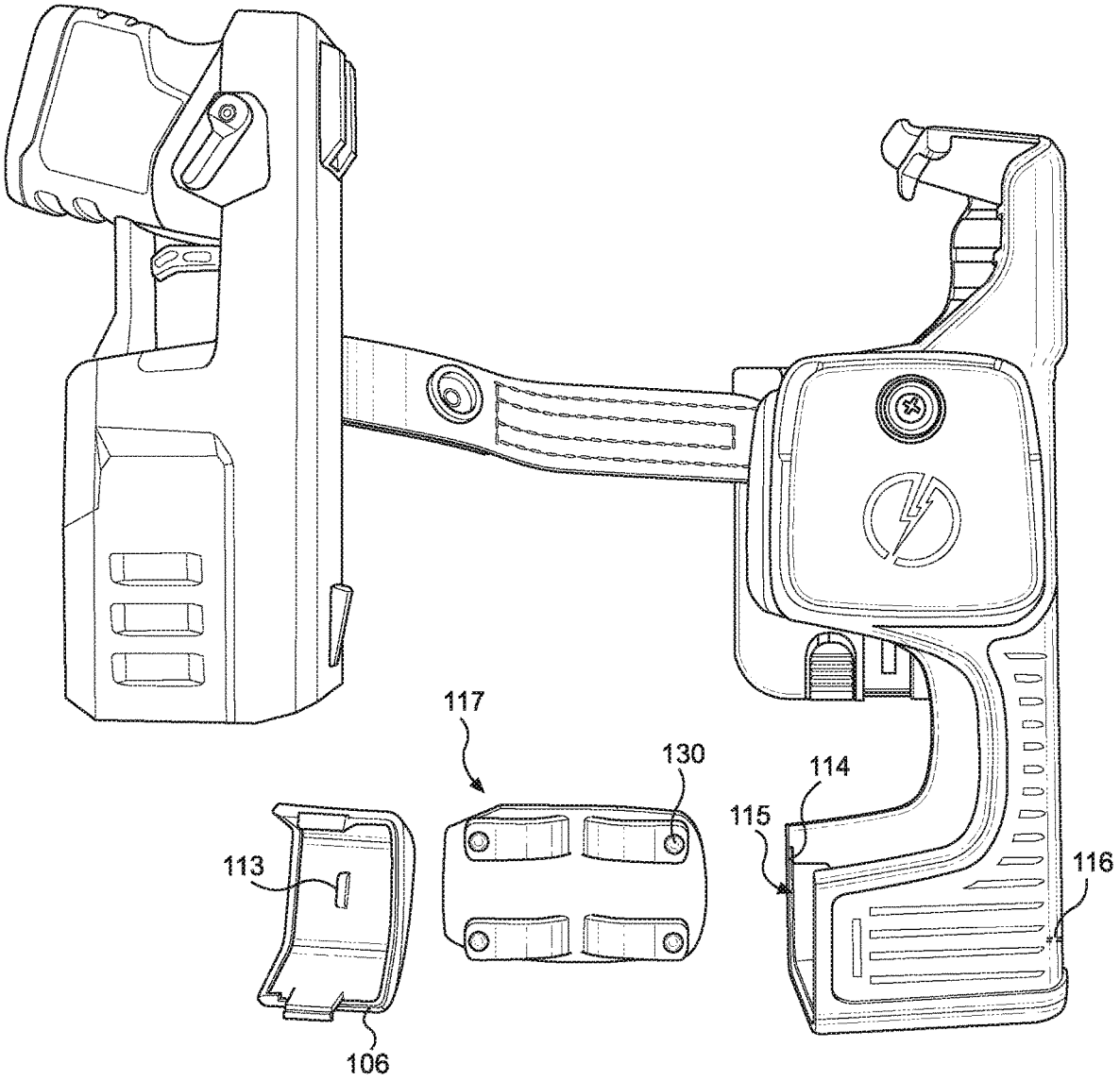
FIG. 6 shows an exploded view of the improved safety holster of FIG. 1, according to one embodiment of the present disclosure.
Figure 7:
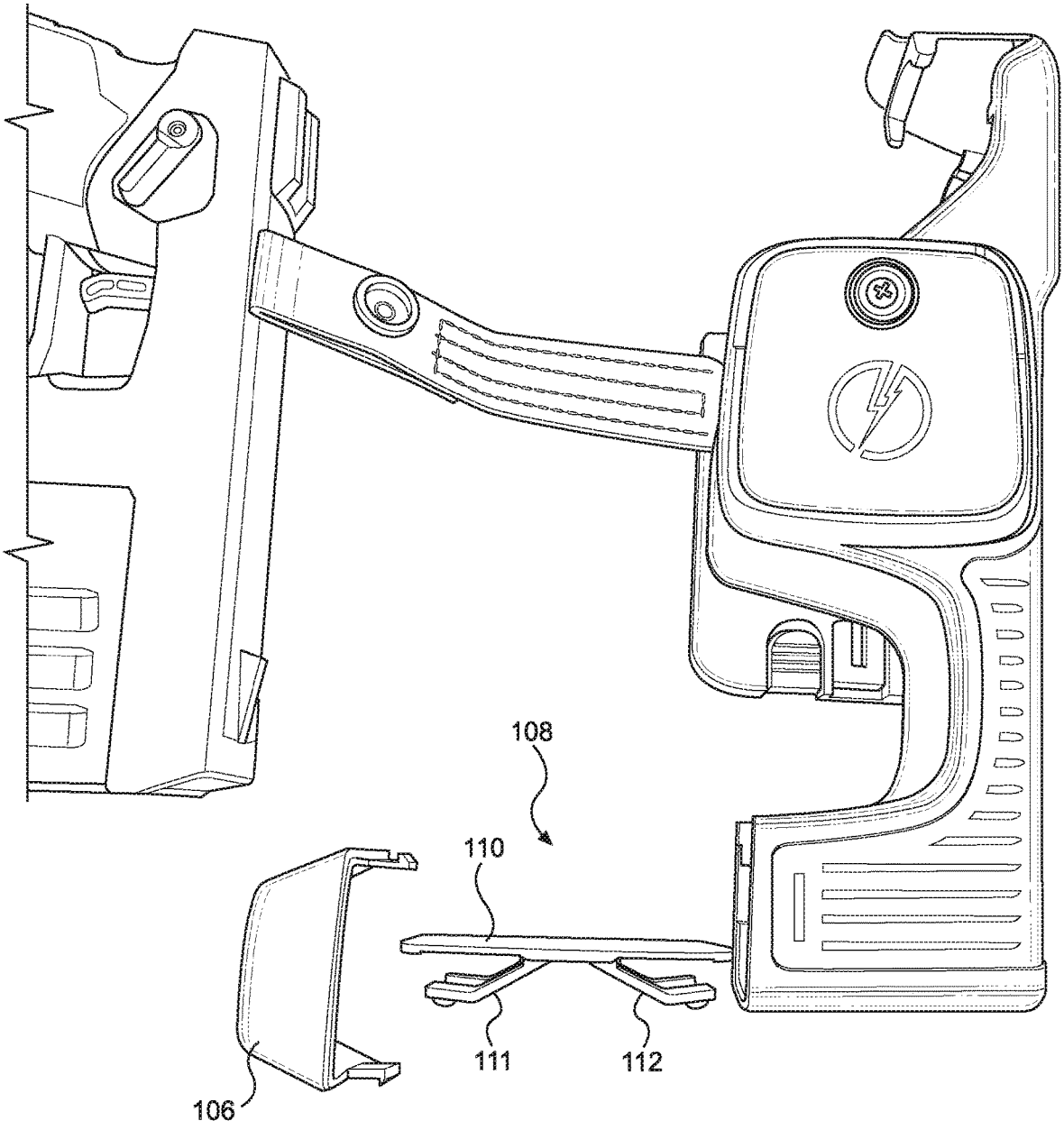
FIG. 7 shows another exploded view of the improved safety holster of FIG. 1, according to one embodiment of the present disclosure.

FIG. 6 shows an exploded view of the improved safety holster of FIG. 1, according to one embodiment of the present disclosure. As shown in FIG. 7, installation cover 106 includes tab 113 and the body of improved safety holster 101 includes tabs 114 and 115 (internal, obscured from view). In some embodiments, tab 116 is included in the body portion of improved safety holster 101, but it is not visible in the orientation shown in FIG. 13. Tabs 113, 114, 115 and 116 may form a substantially planar retention barrier to hold retention pressure mechanism 108 in the receiving and of improved safety holster 101. Tabs 113, 114, 115, and 116 contact pressure plate 110 when improved safety holster 101 is assembled. In some embodiments, pressure plate 110 may include orientation shaping 117 such that each end of pressure plate 110 is shaped to engage in improved safety holster 101 in a proper orientation.

FIG. 7 shows another exploded view of the improved safety holster of FIG. 1, according to one embodiment of the present disclosure. As shown in FIG. 6, installation cover 106 is removed and retention pressure mechanism 108 is removed. Retention pressure mechanism 108 includes pressure plate 110. Pressure plate 110 is a substantially planar surface that creates a terminal end to the receiving portion of improved safety holster 101 when installed. Retention pressure mechanism 108 includes spring elements 111 and 112. In some embodiments, improved safety holster 101 may include different arrangements of spring elements configured to apply a retention force between improved safety holster 101 and sidearm 151 when sidearm 151 is holstered in improved safety holster 101. Retention pressure mechanism 108 may be configured such that the spring elements create a fulcrum that allows pressure plate 110 to rotate or tilt as an installation force or removal force is applied to sidearm 151. When a user installs sidearm 151 in improved safety holster 101, the firing end of sidearm 151 engages pressure plate at an oblique angle. When an installation force is applied, the end of pressure plate 110 near spring element 111 will be compressed, tilting pressure plate 110 to approach an orientation substantially parallel to the firing end of sidearm 151. In some embodiments, retention pressure mechanism 108 may have fewer or more spring elements. In some embodiments, improved safety holster 101 may include spring elements attached to pressure plate 110 nearer the terminal end of pressure plate 110 opposite installation cover 106.

Figure 8:
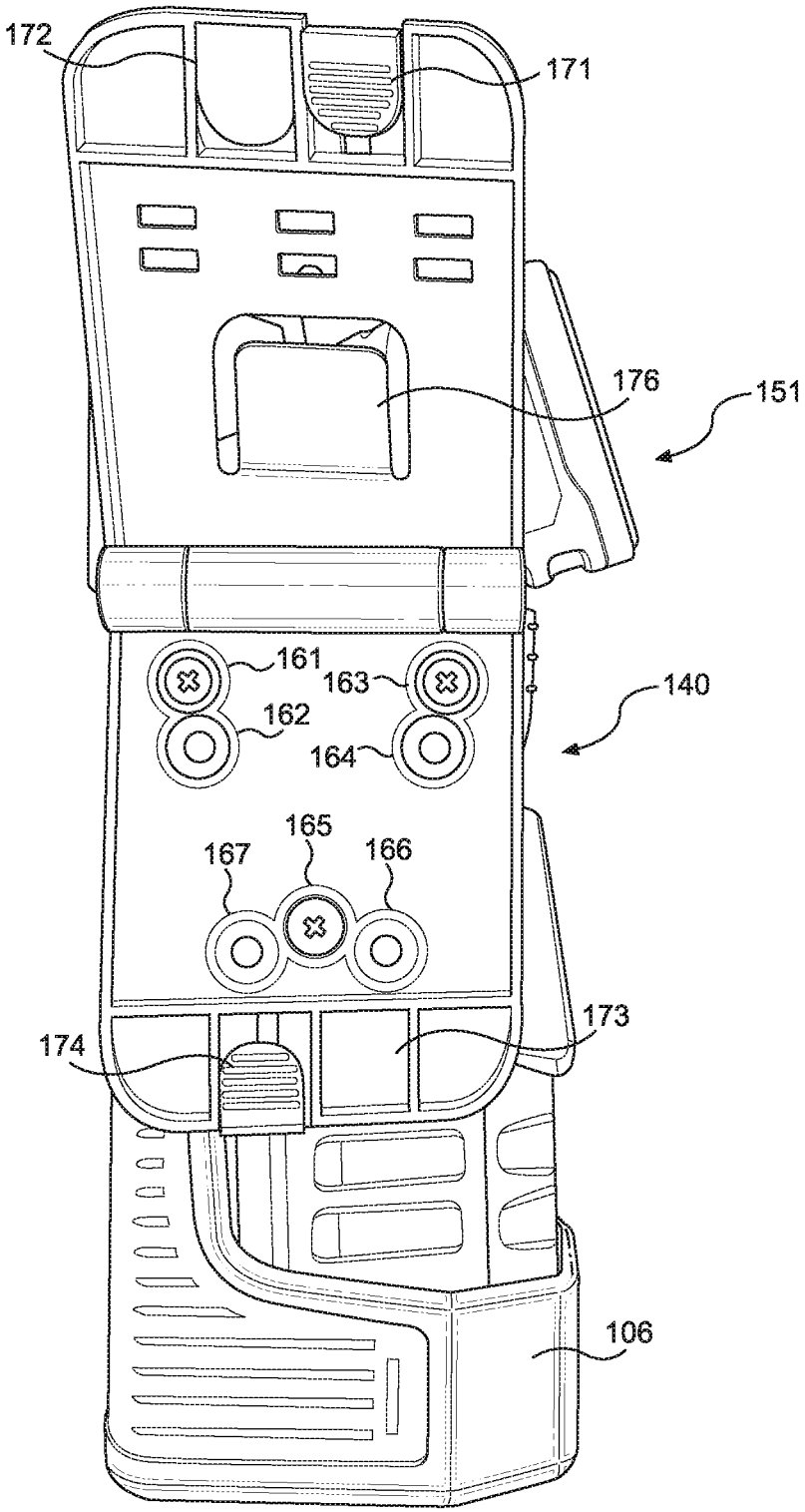
FIG. 8 shows an opposite side view of the improved safety holster of FIG. 1 detailing a belt clip for use with the improved safety holster, according to one embodiment of the present disclosure.

FIG. 8 shows an opposite side view of the improved safety holster of FIG. 1 detailing a belt clip for use with the improved safety holster, according to one embodiment of the present disclosure. As shown in FIG. 8, belt clip 140 includes mounting apertures 161, 162, 163, 164, 165, 166, and 167. Mounting apertures 161, 163 and 165 show mounting screws to position the system in a vertical orientation. In other embodiments, a user may use different combinations of mounting apertures to skew improved safety holster 101 and sidearm 151. Mounting system 100 skewed may facilitate easier access to sidearm 151 for a user, depending on the location where the user has sidearm 151 mounted. Belf clip 140 additionally includes securing clips 171 and 174 which engage with securing apertures 172 and 173, respectively, for engaging belt clip 140 securely on a belt or other mounting strap.

From the above description, it is manifest that various techniques can be used for implementing the concepts described in the present application without departing from the scope of those concepts. Moreover, while the concepts have been described with specific reference to certain implementations, a person having ordinary skill in the art would recognize that changes can be made in form and detail without departing from the scope of those concepts. As such, the described implementations are to be considered in all respects as illustrative and not restrictive. It should also be understood that the present application is not limited to the particular implementations described above, but many rearrangements, modifications, and substitutions are possible without departing from the scope of the present disclosure.

What is claimed is:

1. An improved safety holster, comprising:

a housing configured to receive a pistol-style sidearm;

wherein the housing is made of one or more of a thermoplastic, thermoplastic acrylic-polyvinyl chloride, nylon, and polymer;

wherein a portion of the housing proximal to a lower terminal end of the housing includes an internal tab thereby forming a substantially planar retention barrier to hold a retention pressure mechanism in place at the lower terminal end of the housing;

a retention clip that extends horizontally from an upper terminal end of the housing;

wherein the retention clip is a substantially rigid lever arm used to retain the pistol-style sidearm in place, thereby requiring intentional action to remove the pistol-style sidearm from the housing;

a tab that extends from a terminal end of the retention clip;

wherein the tab is used to apply a removal force when the user is removing the pistol-style sidearm from the housing;

a retention element that extends vertically downwards from a lower face of the retention clip;

wherein the retention clip interacts with a rear end of the pistol-style sidearm, thereby exerting a first retention force on the pistol-style sidearm when the pistol-style sidearm is inserted into the housing;

wherein the exerted first retention force is one that prevents removal of the pistol-style sidearm from the housing without intentional effort;

a retention strap that is fastened to a first side of the housing and extends around the housing to a second side of the housing, wherein the second side of the housing possesses a securing element capable of selectively fastening the retention strap to the second side, thereby exerting a second retention force against the pistol-style sidearm when the pistol-style sidearm is inserted in the housing;

wherein the retention strap is one or more of a nylon, or other flexible material suitable for retaining the pistol-style sidearm in the housing;

wherein the securing element is one or more of a snap, button, or hook-and-loop fastener;

wherein the first side of the housing the retention strap connects to is the side of the housing facing away from the wearer of the housing;

an installation cover that engages with a lower body of the housing and encloses the lower body of the housing when the installation cover is installed in the housing;

wherein the installation cover possesses a pair of prongs and tabs extending from a terminal end of the installation cover that inserts into the lower body of the housing;

wherein the installation cover engages with the lower body of the housing through an installation port on a side of the lower body of the housing;

wherein there are two installation ports;

wherein the installation ports are apertures in the body of the housing which interface with the prongs and tabs on the installation cover to retain the installation cover in place when the installation cover is installed in the lower body of the housing;

wherein the installation cover includes an additional internal tab that forms a substantially planar retention barrier to hold the retention pressure mechanism in place near the lower terminal end of the housing;

a retention pressure mechanism in the lower terminal end of the housing that applies a third retention force on a firing end of the pistol-style sidearm when the pistol-style sidearm is inserted into the housing;

wherein the retention pressure mechanism is one or more of a plate, or spring-loaded element;

wherein the retention pressure mechanism requires a user to apply an installation force on the pistol-style sidearm thereby compressing the retention pressure mechanism and allowing the pistol-style sidearm to clear the retention element for insertion into the housing;

wherein the third retention force applied by the retention pressure mechanism is an upward retention force which thereby engages the pistol-style sidearm with the retention clip and retention element at the upper terminal end of the housing;

wherein the retention pressure mechanism may move in either a linear manner or a pivoting manner;

wherein the retention pressure mechanism is configured such that the spring elements create a fulcrum that allows the retention pressure mechanism to rotate or tilt as an installation or removal force is applied to the retention pressure mechanism;

wherein the retention pressure mechanism may be substantially parallel to the lower terminal end of the housing when at rest;

wherein the retention pressure mechanism includes a pressure plate, wherein the pressure plate is a substantially planar surface that creates a lower terminal end of the housing when installed in the housing;

wherein the retention pressure mechanism also includes at least one of a spring element;

wherein the at least one spring element is attached to the pressure plate near a terminal end of the pressure plate that is opposite to the installation cover.

2. The improved safety holster of claim 1, wherein the housing includes a plurality of internal tabs including the internal tab, and wherein the plurality of internal tabs and the additional internal tab of the installation cover are substantially coplanar with one another and together hold the retention pressure mechanism in place at the lower terminal end of the housing.

3. The improved safety holster of claim 1, wherein the pressure plate contacts the internal tab of the housing and the additional internal tab of the installation cover when no pistol-style sidearm is received in the housing.

4. The improved safety holster of claim 3, wherein the at least one spring element biases the pressure plate into contact with the internal tab of the housing and the additional internal tab of the installation cover.

5. The improved safety holster of claim 1, wherein the pressure plate has a first end and a second end opposite the first end, each of the first end and the second end being shaped to engage the housing in a predetermined orientation.

6. The improved safety holster of claim 1, wherein the at least one spring element comprises a first spring element and a second spring element, each attached to the pressure plate.

7. The improved safety holster of claim 6, wherein the pressure plate is positioned such that the firing end of the pistol-style sidearm engages the pressure plate at an oblique angle as the pistol-style sidearm is inserted into the housing, and wherein application of the installation force depresses an end of the pressure plate adjacent the first spring element, thereby compressing the first spring element and tilting the pressure plate toward an orientation substantially parallel to the firing end of the pistol-style sidearm.

8. The improved safety holster of claim 1, wherein the retention pressure mechanism moves in the pivoting manner, and wherein the pressure plate engages the firing end of the pistol-style sidearm and rotates with the pistol-style sidearm through an acute angle as the pistol- style sidearm is inserted into the housing.

9. The improved safety holster of claim 1, wherein the retention pressure mechanism moves in the linear manner along a long axis of the housing.

10. The improved safety holster of claim 1, wherein the installation cover is selectively removable from the lower body of the housing, and wherein removal of the installation cover permits the retention pressure mechanism to be installed in and removed from the housing.

11. The improved safety holster of claim 1, wherein the retention element is configured to be received within a retention pocket of the pistol-style sidearm when the pistol-style sidearm is inserted into the housing.

12. The improved safety holster of claim 1, further comprising a belt clip attached to the housing, the belt clip comprising an inner clip plate and an outer clip plate that define a belt channel configured to receive a belt.

13. The improved safety holster of claim 12, wherein the belt clip includes a plurality of mounting apertures, and wherein the belt clip is attached to the housing by mounting screws received in a subset of the plurality of mounting apertures, the subset determining an orientation of the housing relative to the belt clip, the orientation being one of a first orientation and a second orientation angularly offset from the first orientation.

14. The improved safety holster of claim 12, wherein the belt clip includes a securing clip and a securing aperture, the securing clip being configured to engage the securing aperture to secure the belt clip on a belt received in the belt channel.

15. The improved safety holster of claim 1, wherein the pistol-style sidearm that the housing is configured to receive is a less-lethal device that incapacitates by electrical current.

* * * * *